United States Patent [19]

Kramer

[11] Patent Number: 4,543,903

[45] Date of Patent: Oct. 1, 1985

[54] DOCK CONNECTOR AND STABILIZER

[76] Inventor: Donald J. Kramer, Rte. 1, Box 26-A, Wilbur, Wash. 99185

[21] Appl. No.: 438,112

[22] Filed: Nov. 1, 1982

[51] Int. Cl.[4] ..... B63B 35/00

[52] U.S. Cl. ..... 114/263; 114/230; 114/249; 405/219

[58] Field of Search ..... 114/263, 267, 217, 230, 114/249; 405/214, 219; 403/229, 291; 267/166, 174, 179, 170, 178; 280/483, 485, 486

[56] References Cited

U.S. PATENT DOCUMENTS

| | | | |
|---|---|---|---|
| 1,818,138 | 8/1931 | Howland | 244/3 |
| 2,234,504 | 3/1941 | Robinson et al. | 267/166 |
| 2,912,953 | 11/1959 | Olsen | 114/230 |
| 3,041,060 | 6/1962 | Jacobsen | 267/166 |
| 3,177,839 | 4/1965 | Nolf | 114/230 |
| 3,276,209 | 10/1966 | Mosdell | 114/266 |
| 3,306,053 | 2/1967 | Fulton | 114/266 |
| 3,799,100 | 3/1974 | Marriner | 114/249 |
| 3,949,699 | 4/1976 | Heese et al. | 114/249 |
| 4,321,882 | 3/1982 | Sluys | 114/266 |

FOREIGN PATENT DOCUMENTS

| | | | |
|---|---|---|---|
| 227557 | 5/1963 | Austria | 114/248 |
| 828649 | 1/1952 | Fed. Rep. of Germany | 114/230 |

*Primary Examiner*—Trygve M. Blix
*Assistant Examiner*—Edwin L. Swinehart
*Attorney, Agent, or Firm*—Wells, St. John & Roberts

[57] ABSTRACT

Disclosed is a dock connector for connecting two adjacent floating docks. The dock connectors are designed to accommodate substantial lateral, vertical and end-to-end relative motion between the docks. The dock connector includes mounting plates which are securely fastened to each dock segment and a spring which spans between and connects the two mounting plates. Spring connection means are provided to securely attach the ends of the spring to the mounting plates. Deflection limiters attached to the mounting plates help to support the spring and to prevent it from becoming sprung by over-deflection.

7 Claims, 3 Drawing Figures

FIG 1
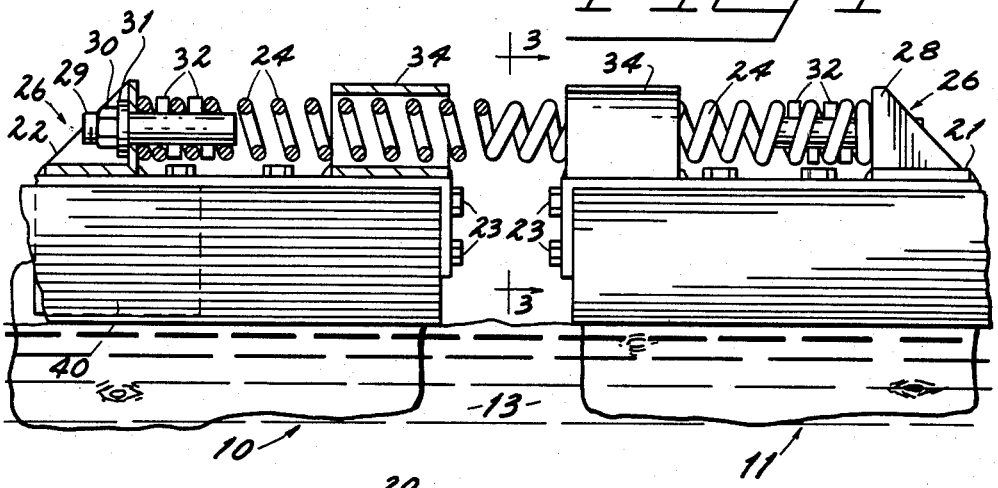
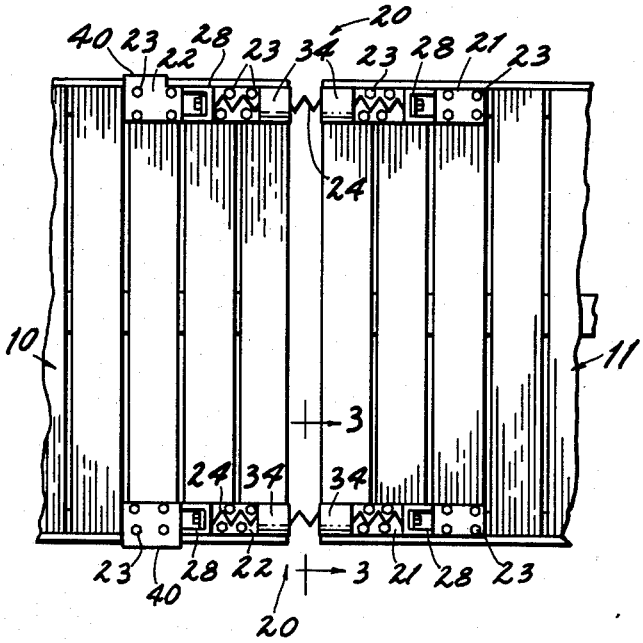
FIG 2
FIG 3
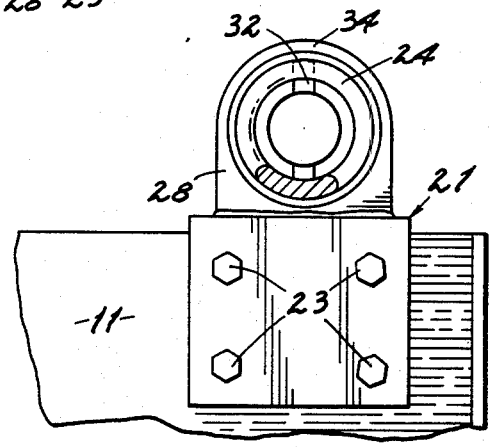

DOCK CONNECTOR AND STABILIZER

TECHNICAL FIELD OF THE INVENTION

The technical field of this invention is connectors for securing two floating docks together.

BACKGROUND OF THE INVENTION

Floating docks are used widely in the United States and in other countries, especially on inland lakes and waterways. The action of high winds and waves upon these docks cause them to heave and twist. Each dock or dock segment tends to move independently from its adjacent dock segment. This creates substantial problems in trying to connect two adjacent dock segments together because of the substantial forces which develop when the dock segments move relative to each other.

Some have attempted to solve this problem by rigidly connecting two dock segments to each other. Such an approach is sometimes satisfactory, especially on small lakes, coves or where the docks are otherwise protected from the action of high winds and waves. This rigid connection approach has been found otherwise unsatisfactory because the forces between the dock segments tends to destroy the connectors. If the connectors are made very strong, then the dock itself tends to be destroyed.

Another approach to connecting dock segments was to leave them relatively far apart providing a substantial amount of slack in cables or chains between the docks. This allowed the two dock segments to rock and pitch with respect to each other. This approach often made it difficult for people to jump from one dock to another unless a gangplank was laid between the two docks. Occasionally large springs were used somewhere in the chain assembly which spanned between the two dock segments. These springs helped to cushion the forces when the dock segments separated violently.

The current invention seeks to solve the long standing problem of having a suitable dock connector which allows the docks to move relative to each other, yet maintain them in close enough position so that the dock is very convenient to use. The invention is also directed to solving other problems which are discussed below or which are inherent in the structure or function discussed below.

BRIEF DESCRIPTION OF THE DRAWINGS

A preferred form of the present invention is illustrated in the accompanying drawings in which:

FIG. 1 is a side elevational view of the stock connector as it is used to secure two dock segments together. End portions of the mounting brackets have been broken away for enlarged presentation. Portions of the left part of the connector are shown in section.

FIG. 2 is a top view showing portions of two dock segments joined by dock connectors as shown in FIG. 1;

FIG. 3 is a sectional view taken along line 3—3 of FIG. 1.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

FIG. 1 shows a first dock or dock segment 10 which is adjacent to a second dock or dock segment 11. Both docks are floating upon a body of water 13. Referring to FIG. 2 we see that there are two dock connectors 20 which span between adjacent docks 10, 11. Dock connectors 20 each have a first mounting bracket 21 and a second mounting bracket 22 which are secured to the first dock segment 10 and second dock segment 11, respectively, by fasteners 23. Mounting brackets 21 and 22 preferably are L-shaped and extend down the adjacent end faces of the docks 10, 11. The L-shaped configuration is not necessary and flat mounting brackets are equally acceptable. First brackets 21 are shown with optional side stabilizing plates 40 which extend downward over the side edge of the dock. Side stabilizing plate 40 can be mounted to the dock with fasteners (not shown).

Spring 24 spans between the first and second mounting brackets 21 and 22 and is connected to the mounting brackets at each end by spring connection means 26 (see FIG. 1). Spring 24 is advantageously a helical extension compression spring as shown in FIG. 1.

Spring connection means 26 are preferably constructed of spring brackets 28 which are welded to the mounting brackets and stand upwardly to provide a surface against which spring 24 bears under compression. Spring connection means 26 also include attachment means which in the preferred embodiment is a bolt or shaft 29 having prongs 32 which extend into the coil of the spring and prevent it from sliding away from the spring bracket 28 when the spring is under tension. Bolt 29 is retained upon spring bracket 28 by a nut 30 and washer 31. Alternative spring connection means 26 and attachment means 29, 30, 31, 32 are readily available and are clearly within the comtemplation of this invention. The spring bracket and prong nut arrangement shown herein for the spring connection means 26 is advantageous because it allows spring 24 to be secured to the mounting brackets 21, 22 without having a rigid clamping connection to the spring. The flexibility of such a spring connection means 26 allows the spring to flex more easily throughout its entire length, thereby accommodating greater spring deflection and greater relative motion between the dock segments 10, 11.

Spring 24 need not be of any particular size or spring rate but must be sufficiently strong so that motion of the docks 10, 11 will not cause it to become sprung or broken. The larger the docks being connected, the greater the size of the spring which must be used.

Spring 24 is prevented from overdeflection or undue transverse forces by deflection limiters 34. Deflection limiters 34 are preferably circular sleeve which extend upward from the mounting brackets 21, 22 and surround the circumference or periphery of spring 24. Sleeves extending only partially about the periphery or some other geometry which supports the spring are equally suitable and are within this invention.

It is desirable to have clearance between spring 24 and deflection limiters 34 so that the spring may work axially back and forth within the deflection limiters. Clearance between the spring 24 and deflection limiters 34 also allows the spring to bend or curve along its entire length with the lateral and vertical position of spring 24 confined by the location of deflection limiters 34. This contributes to the dock connector's ability to accommodate relatively large transverse and vertical deflection caused by relative motion between dock segments 10, 11.

Deflection limiters 34 are preferably attached at positions near the adjacent ends of mounting brackets 21 and 22.

Although FIG. 2 shows two dock connectors used to connect dock segments together, it is possible to use the dock connectors wherever relative motion between floating docks must be accommodated. Three, four, five or even greater numbers of dock connectors could be used to attach larger docks. If desired, docks could also be attached in side-to-side juxtaposition as well as the end-to-end juxtaposition shown in FIG. 2.

All parts of the connectors are preferably made of steel of types suitable for spring and for structural steel as is well-known in the art.

In compliance with the statue, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A dock connector for securing a first dock to a second dock, comprising:

first and second mounting brackets having planar surfaces adapted for attachment to the first and second docks, respectively;

first and second spring brackets rigidly connected to said first and second mounting brackets and having upstanding surfaces thereon;

a helical extension compression spring spanning between and connecting said first and second spring brackets;

first and second spring connection means for loosely engaging and connecting said spring to said first and second spring brackets, respectively;

first and second tubular deflection limiters rigidly connected to said first and second mounting brackets, respectively; said deflection limiters extending about at least a portion of said spring in loose fitting relationship thereto, to restrict lateral and vertical deflection thereof while allowing limited relative motion between the spring and deflection limiters.

2. The dock connector of claim 1 wherein the deflection limiters are tubular sleeves circumferentially surrounding a length of the spring in a loose fitting relationship.

3. The dock connector of claim 1 wherein the deflection limiters are positioned near the adjacent ends of mounting brackets.

4. The dock connector of claim 1 wherein the deflection limiters are cylindrical tubular sleeves loosely surrounding the spring and are positioned near the adjacent ends of the mounting brackets.

5. The dock connector of claim 1 wherein said first and second spring connection means comprise:

shafts rigidly connected to said first and second spring brackets and extending within the helical extension compression spring in loose fitting relationship therewith; and at least one engagement prong extending outwardly from said shafts to loosely engage said spring and retain said spring to said shafts.

6. The dock connector of claim 5 wherein said shafts are a bolt extending through apertures in said spring bracket.

7. The dock connector of claim 1 wherein the mounting brackets are L-shaped with a short leg of the L extending over the end of the docks.

* * * * *